US006407707B2

(12) United States Patent
Nakamura et al.

(10) Patent No.: US 6,407,707 B2
(45) Date of Patent: Jun. 18, 2002

(54) PLANE ANTENNA

(75) Inventors: Katsuro Nakamura, Kawagoe; Fumihiko Kutsukake, Sakado, both of (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 09/891,796

(22) Filed: Jun. 26, 2001

(30) Foreign Application Priority Data

Jun. 27, 2000 (JP) ..... 2000-193194
Jan. 31, 2001 (JP) ..... 2001-023523

(51) Int. Cl.[7] ..... H01Q 1/38
(52) U.S. Cl. ..... 343/700 MS; 343/850
(58) Field of Search ..... 343/700 MS, 846, 343/848, 853, 850

(56) References Cited

U.S. PATENT DOCUMENTS

| | | | | |
|---|---|---|---|---|
| 4,008,438 A | | 2/1977 | Shinkawa et al. | 325/446 |
| 4,543,579 A | | 9/1985 | Teshirogi | 343/700 MS |
| 4,866,451 A | | 9/1989 | Chen | 343/700 MS |
| 4,987,421 A | * | 1/1991 | Sunahara et al. | 343/700 MS |
| 5,001,492 A | * | 3/1991 | Shapiro et al. | 343/700 MS |
| 5,734,350 A | * | 3/1998 | Deming et al. | 343/700 MS |
| 5,982,326 A | * | 11/1999 | Chow et al. | 343/700 MS |

FOREIGN PATENT DOCUMENTS

| | | | |
|---|---|---|---|
| EP | 0 752 756 A | 1/1997 | H03D/9/06 |
| EP | 0 767 511 A | 4/1997 | H01Q/21/06 |
| WO | 96/36136 A | 11/1996 | H04B/7/10 |

OTHER PUBLICATIONS

"Thin Antenna Technology", Kiyohiko ITOH and Tasuku Teshirogi, B vol. J71–B No. 11, pp. 1217–1227, Nov. 1988.

* cited by examiner

*Primary Examiner*—Don Wong
*Assistant Examiner*—Hoang Nguyen
(74) *Attorney, Agent, or Firm*—Frishauf, Holtz, Goodman, Langer & Chick P.C.

(57) ABSTRACT

An object of the present invention is to provide a miniaturized plane antenna having good axial ratio characteristics over a broad frequency range. An antenna equipped with feeding points at two axial directional impedance matching points of a radiation electrode formed on a surface of a dielectric substrate is mounted on a two-layer wiring board equipped with a 90° hybrid and ports. In the wiring board, the 90° hybrid by means of a closed conductor pattern is configured to have ports drawn out toward an inside of the closed conductor pattern to be connected with the antenna and another port to be connected to a coaxial line, and an earth conductor is arranged outside the closed conductor pattern so as to surround it or inside the closed conductor pattern. The 90° hybrid is adapted to be accommodated in a back face of the antenna.

30 Claims, 12 Drawing Sheets

(A)

(B)

(C)

(A)

(B)

(C)

(A) 2400MHZ (B) 2450MHZ (C) 2500MHZ (A)

(B)

(C)

PLANE ANTENNA

FIELD OF THE INVENTION

The present invention relates to a circularly polarized wave plane antenna which is small in size and has a good (lower) axial ratio characteristic over a broad frequency range, and is constructed with a dielectric plane antenna and a 90° phase adjusting circuit (hereafter referred to as a 90° hybrid).

DESCRIPTION OF THE PRIOR ART

In most of circularly polarized wave antennas of the prior art by means of dielectric plane antennas using patch electrodes, typically one-point feeding technique has been employed and frequency ranges exhibiting good axial ratio have been limited. GPS has a center frequency of 1575.42 MHz and a relatively narrow fractional band width of 0.13% for a frequency range of ±1.023 MHz around it, and accordingly there has not been required to extend the frequency range with good axial ratio. As a result, no problem has arisen with a micro strip circularly polarized wave antenna of one-point feeding.

However, as much higher frequency ranges have been used in communications and broadcastings, the fractional band width, for example, for a radio LAN using ISM band of 2450 MHz±50 MHz has become 4.1%, and thereby there has arisen a need to extend a good axial ratio-frequency range.

Conventionally, a circularly polarized wave antenna employing a 90° hybrid has been uncommonly used for the purpose where the only one element is used. In order to obtain an antenna having a narrower directivity with higher gain, a number of radiation electrodes and the 90° hybrids have usually been arranged on the same face, as shown in FIG. 1, in an antenna array of such a configuration as shown in FIG. 2. As a result, the 90° hybrids have turned to occupy a larger area than the radiation electrodes, which means that it is not suitable for miniaturization.

The present invention has been made to provides a miniaturized circularly polarized wave plane antenna which may be used not only in a radio LAN of 2450 MHz band but also in communications requiring good axial ratio over broad band areas, such as a 5150–5250 MHz band radio LAN and a 5250–5350 MHz band radio access, a 5795–5845 MHz band ETC, a satellite digital broadcasting and the like.

SUMMARY OF THE INVENTION

The present invention has overcome the above problems by providing a novel structure, in which a dielectric plane antenna element and a 90° hybrid are placed one on the other so that the 90° hybrid may be accommodated in the back face of the dielectric plane antenna element. Further, the present invention is made to improve the property thereof by improving a connection structure of the 90° hybrid with a coaxial line as well as with the antenna element.

A plane antenna according to the present invention has a 90° hybrid which has a grounding face of a plane antenna element formed in a surface of a printed substrate as a 90° hybrid, and a conductor pattern having one wave length in one circle and an earth pattern respectively formed in a back face of the printed substrate, respectively, and the antenna element is arranged over the grounding face.

As for a connection and a layout of the coaxial line with respect to the conductor pattern and the earth pattern, if the coaxial line is directly derived outwardly from the connection point, a balance between resonant frequencies in the X- and the Y-directions could be lost leading to a reverse affection to the axial ratio characteristics in the circularly polarized wave property. The present invention provides a circularly polarized wave plane antenna which allows the balance between the resonant frequencies in the X- and the Y-directions to be hardly lost and exhibits a good and stable axial ratio characteristics in the circularly polarized wave property.

More specifically, the present invention provides a novel plane antenna comprising: a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports for connecting said closed conductor pattern with each of said feeding points, and two coaxial line connecting ports, at least one of which is connected to a transmitting or receiving circuit, said plane antenna characterized in that: said 90° hybrid is formed into a wiring board having not less than two layers; said two ports to be connected to said feeding points are drawn out toward an inside of said closed conductor pattern; and an earth pattern is formed surrounding said closed conductor pattern, wherein said inwardly drawn out ports are connected with said feeding points; one of said ports of said closed conductor pattern and said earth pattern are connected with a core line and a sheath line of a coaxial line respectively; and said 90° hybrid is disposed in a back face of said dielectric plane antenna element.

Further, the present invention provides another novel plane antenna comprising: a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports for connecting said closed conductor pattern with each of said feeding points and two coaxial line connecting ports, at least one of which is connected to a transmitting or receiving circuit, said plane antenna characterized in that: said 90° hybrid is formed into a wiring board having not less than two layers; said two ports to be connected to said feeding points are drawn out toward an inside of said closed conductor pattern; and an earth pattern is formed surrounding said closed conductor pattern, wherein said inwardly drawn out ports are connected with said feeding points; one of said ports of said closed conductor pattern and said earth pattern are connected with a coaxial line respectively at central locations on a side of said closed conductor pattern; and said 90° hybrid is disposed in a back face of said dielectric plane antenna element.

Still further, the present invention provides another novel plane antenna comprising: a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports for connecting said closed conductor pattern with each of said feeding points and two coaxial line connecting ports, at least one of which is connected to a transmitting or receiving circuit, said plane antenna characterized in that:

said 90° hybrid is formed into a wiring board having not less than two layers; said two ports to be connected to said feeding points are drawn out from locations approximately on a diagonal line of said wiring board of said closed conductor pattern toward an inside thereof; and an earth pattern is formed surrounding said closed conductor pattern, wherein said inwardly drawn out ports are connected with said feeding points; one of said ports of said closed conductor pattern and said earth pattern are connected with a core line and a sheath line of a coaxial line respectively at locations approximately on a diagonal line of said wiring board; the other port not to be connected to the feeding point nor to the coaxial line is connected to the earth pattern via an impedance element; and said 90° hybrid is disposed in a back face of said dielectric plane antenna element.

According to another aspect, the present invention provides another novel plane antenna comprising: a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports for connecting said closed conductor pattern with each of said feeding points and two coaxial line connecting ports, at least one of which is connected to a transmitting or receiving circuit, said plane antenna characterized in that: said 90° hybrid is formed into a wiring board having not less than two layers; said two ports to be connected to said feeding points are drawn out toward an inside of said closed conductor pattern; and an earth pattern is formed inside said closed conductor pattern, wherein said inwardly drawn out ports are connected with said feeding points; one of said ports of said closed conductor pattern and said earth pattern are connected with a core line and a sheath line of a coaxial line respectively; and said 90° hybrid is disposed in a back face of said dielectric plane antenna element.

Still further, the present invention provides another novel plane antenna comprising: a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports for connecting said closed conductor pattern with each of said feeding points and two coaxial line connecting ports, at least one of which is connected to a transmitting or receiving circuit, said plane antenna characterized in that: said 90° hybrid is formed into a wiring board having not less than two layers; said two ports to be connected to said feeding points are drawn out toward an inside of said closed conductor pattern; and an earth pattern is formed into an island-like shape inside said closed conductor pattern, wherein said inwardly drawn out ports are connected with said feeding points; one of said ports of said closed conductor pattern and said earth pattern are connected with a core line and a sheath line of a coaxial line respectively at a central location on an edge of said closed conductor pattern; and said 90° hybrid is disposed in a back face of said dielectric plane antenna element.

Yet further, the present invention provides another novel plane antenna comprising: a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports for connecting said closed conductor pattern with each of said feeding points and two coaxial line connecting ports, at least one of which is connected to a transmitting or receiving circuit, said plane antenna characterized in that: said 90° hybrid is formed into a wiring board having not less than two layers; said two ports to be connected to said feeding points are drawn out from locations on a diagonal line of the wiring board toward an inside of said closed conductor pattern; and an earth pattern is formed into an island-like shape inside said closed conductor pattern, wherein said inwardly drawn out ports are connected with said feeding points; one of said ports of said closed conductor pattern and said earth pattern are connected with a core line and a sheath line of a coaxial line respectively at the locations approximately on a diagonal line of the wiring board; the other port not to be connected to the feeding point nor to the coaxial line is connected to the earth pattern via an impedance element; and said 90° hybrid is disposed in a back face of said dielectric plane antenna element.

Components of a plane antenna according to the present invention are as follows:

A dielectric plane antenna element comprising a square or circular patch which includes a radiation electrode equipped with two feeding points on matching locations in two axial directions;

a wiring board of not less than two layers, on which a 90° hybrid and a conductor pattern serving as a port for said 90° hybrid are formed, wherein a conductor formed on one surface operates as a grounding electrode of the antenna, and on the other surface, there are provided a 90° hybrid made up of closed conductor pattern having one wave length in one circle, two ports drawn out toward an inside of the closed conductor pattern for connecting respective feeding points, and two coaxial line connecting ports to be connected to a transmitting or receiving circuit and an earth pattern surrounding the closed conductor pattern or another earth pattern formed inside the closed conductor pattern; and a coaxial line to be connected to the port of the 90° hybrid and the earth pattern.

An impedance matching connection of the port not to be coupled with the coaxial line and the earth pattern may be accomplished by a resistor of 50Ω or by the pattern on the wiring board.

The characteristics of the antenna may be improved by guiding the coaxial line from the center point of one side of the closed conductor pattern across the closed conductor pattern, or from one corner of the closed conductor diagonally across the closed conductor pattern, so as to be drawn outside of the wiring board.

DETAILED DESCRIPTION OF THE PREFERRED EMBODIMENTS

Preferred embodiments of the present invention will now be described below with reference to the attached drawings.

Figure 1:
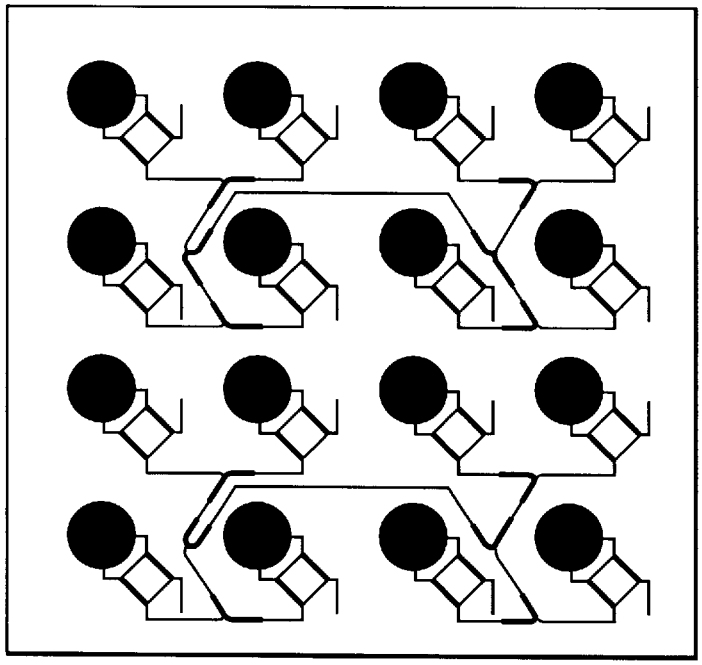
FIG.1 (PRIOR ART)
FIG. 1 is a plan view of a plane antenna of the prior art.
Figure 2:
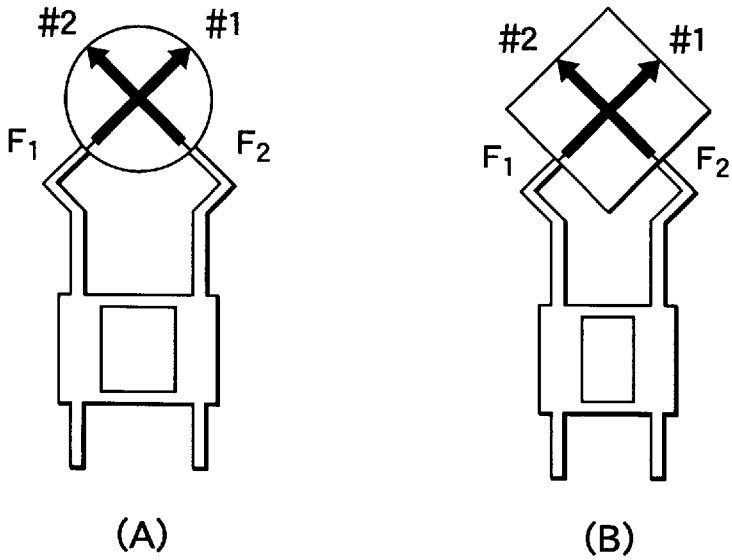
FIG.2 (PRIOR ART)
FIG. 2 illustrates exemplary plane antennas of the prior art.
Figure 3:
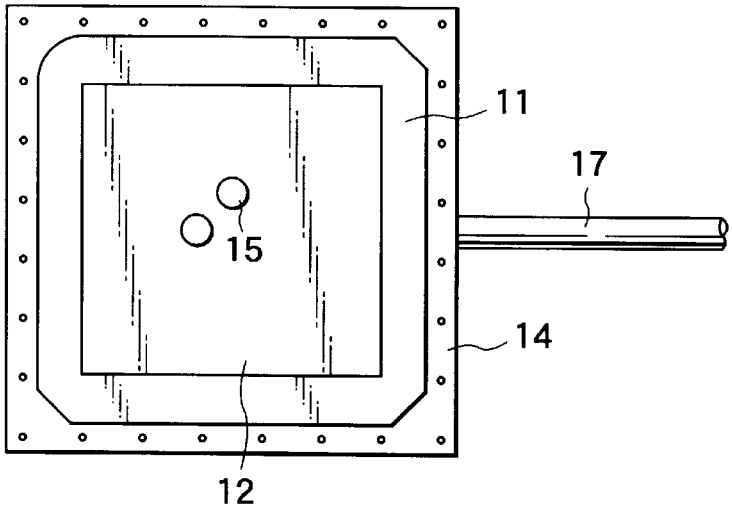
FIG. 3 illustrates an embodiment of the present invention, wherein (A) is a plan view, (B) is a front plane view, and (C) is a rear elevational view respectively.
Figure 3:
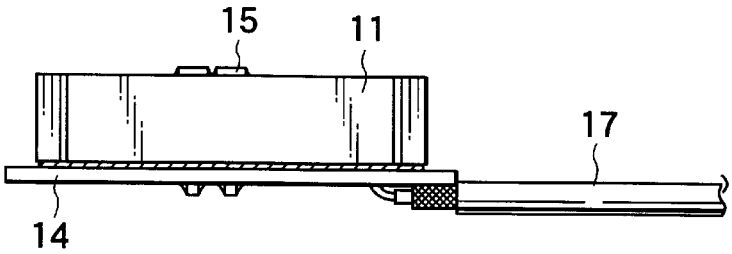
Figure 3:
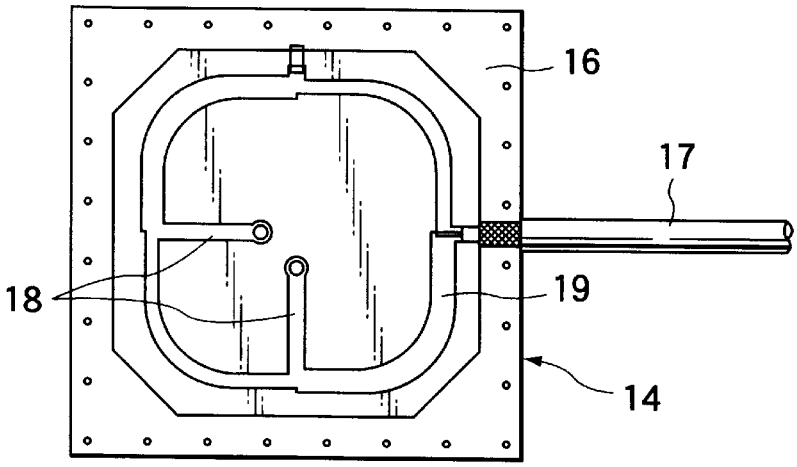

FIG. 3 illustrates an embodiment of the present invention, wherein (A) is a plan view, (B) is a front elevational view, and (C) is a rear plane view respectively. An antenna element 11, for a center frequency of 2450 MHz and a band width of 100 MHz, comprises a patch electrode 12 of 20 mm×20 mm formed on a surface of a dielectric substrate approximately in a square of 26 mm×26 mm having a thickness of 6 mm made of ceramic dielectric material in such a system of magnesium-calcium-titanium with a dielectric constant of 8. The antenna element 11 is composed of two independent micro strip antennas in which an X-directional and a Y-directional polarization axes intersect with each other orthogonally and each of two feeding pins 15 is penetrated though each of two 50Ω points disposed on the orthogonal lines connecting center points on respective two opposite sides of the patch.

A wiring board 14 is made to have a ground pattern covering its one full surface except for a clearance at the locations of the feeding pins 15 of the antenna element, thus to be formed into a grounding conductor. The feeding is made via a 90° hybrid, as will be explained later, and a connection to an external circuit is established via a coaxial line 17.

FIG. 3(C) is a plan view of an exemplary 90° hybrid formed on the wiring board. It shows an example of a conductor pattern to be formed on other surface of the two-layer wiring board 14. A formed conductor pattern 19 of 90° hybrid has one wave length in one circle of 70.4 mm (a diameter of about 22.4 mm), comprising a thick arm having a characteristic impedance of 35.4Ω and a narrow arm having a characteristic impedance of 50Ω placed alternately by every 90° along the circle, with the corner portions thereof being round and the portions between respective corner portions being straight. The periphery of the conductor pattern 19 is surrounded with an earth pattern 16.

Two conductor patterns 18 of the same length each having the characteristic impedance of 50 ohms are drawn out from the respective opposite ends of one of the 50Ω narrow arms toward an inside of the closed pattern 19. Said conductor patterns 18 are extended to locations corresponding to those feeding points of the antenna element and connected via the feeding pins 15 to a radiation electrode.

One of the ends of the other 50Ω arm is coupled to a coaxial line 17 at the characteristic impedance of 50 ohms. That is, one end of the 50Ω arm is coupled with a core line of the coaxial line 17 and the earth pattern is coupled with a sheath line of the coaxial line. The other end of said other 50Ω arm is couple to the earth pattern 16 also at a matched impedance of 50Ω. Typically, a chip resistor of 50Ω is used to be soldered thereto. The earth pattern 16 has been coupled to the full face grounding pattern on the opposite surface by through holes or the like.

The reason why good axial ratio or good frequency characteristic is obtained with the two-point feeding circularly polarized wave antenna will be described below. Radiation pattern of a square (so as a circular) dielectric plane antenna element resonates as the two orthogonal antennas in the X-direction and Y-direction. At the frequency proximal to the center frequency, a received power induced by the X-directional resonance and a received power induced by the Y-directional resonance respectively to the circularly polarized wave are equal to each other, which results in a preferable value indicating a low axial ratio representative of the ratio between the two as expressed by decibels. To take out the received output, when a 90° hybrid having two ports for input and two ports for output is used to synthesize an output from the two-point feeding micro strip antenna having the 50Ω feeding points on the vertical lines standing on the centers of the X- and the Y-sides respectively, there will be obtained a right-handed polarized wave at one end of the output port and a left-handed polarized wave at the other end of the output port.

Figure 4:
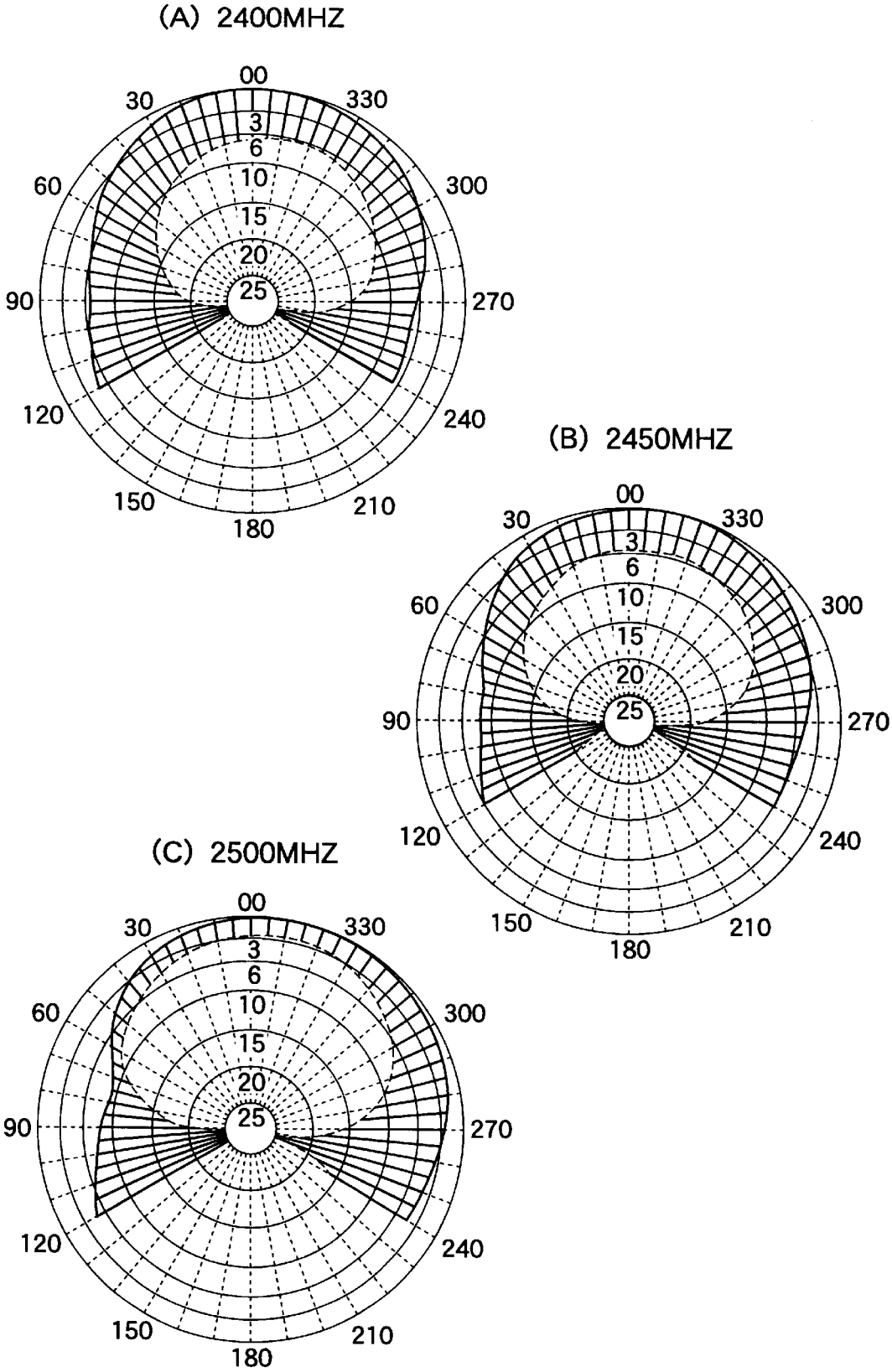
FIG. 4 is a plurality of diagrams for explaining characteristics of a plane antenna according to the present invention.

FIG. 4 shows the axial ratio characteristic for each of the different radiation angles at the edge frequency in the frequency band width and the axial ratio characteristic for each of the different radiation angles at the center frequency in the frequency band width, in a case where the wiring board illustrated in FIG. 3 is used and the coaxial line is coupled to the central portion of the side of the feeding substrate 14 to be directly drawn out from the central portion. That is the case where the core line of the coaxial line is drawn out at the location on the centerline of the side in the direction normal to the side. From the diagrams, it is seen that longer bar length has poor axial ratio. In that case, it has been found that the axial ratio is insufficient.

Figure 5:
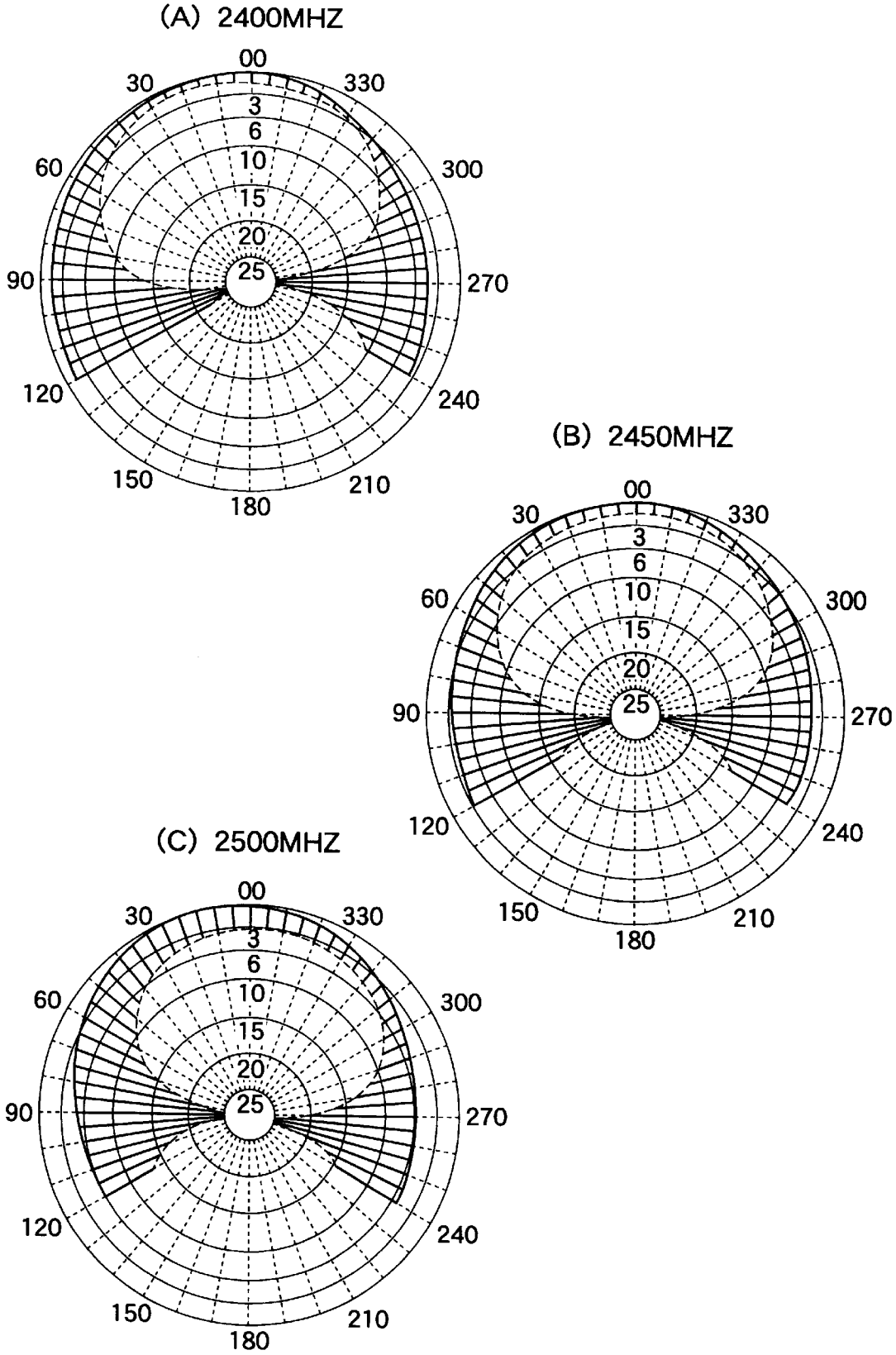
FIG. 5 is also a plurality of diagrams for explaining characteristics of a plane antenna according to the present invention.

FIG. 5 shows the characteristics for a case where a coupling location of the coaxial line with the port and a drawing out location of the coaxial line to the outside are oriented along the diagonal line of the wiring board. As can be seen from the diagrams, just changing the direction of drawing out may improve the axial ratio.

Figure 6:
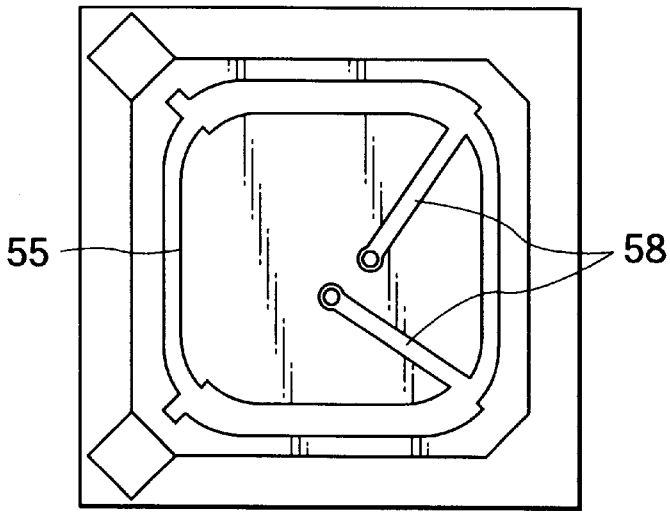
FIG. 6 is a plan view of an exemplary wiring board to be used in the present invention.

FIG. 6 is a plan view of another embodiment according to the present invention, illustrating a 90° hybrid of different shape. In this embodiment, a 90° hybrid pattern 55 is arranged such that connecting points of arms are disposed on the diagonal lines of a square wiring board and 50Ω conductor patterns 58 of the same length are formed from the opposite ends of one 50Ω arm to be extended inward to locations corresponding to feeding points of an antenna element.

Figure 7:
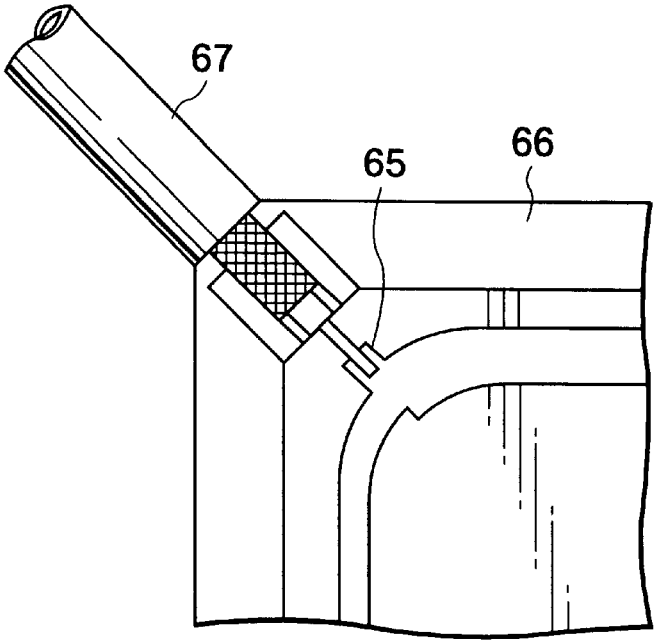
FIG. 7 is a partial plan view, illustrating an embodiment of the present invention.

FIG. 7 shows a connection structure between the 90° hybrid of FIG. 6 and the coaxial line, in which a pattern drawn out from a connecting point of a 90° hybrid pattern 65 to the outside is coupled with a core line and an earth pattern 66 is coupled with a sheath line of a coaxial line 67. Such arrangement of drawing out at a corner portion may make a grounding board sized equally in the X- and the Y-directions, resultantly extending the axial ratio-frequency range.

A dielectric constant of a dielectric antenna element specifies the size of an antenna element, and further a dielectric constant of a wiring board specifies the size of a 90° hybrid pattern. If the dielectric constant of the wiring board is adapted to be substantially 40% to 130% of the dielectric constant of the substrate of the antenna element, the 90° hybrid pattern can be accommodated in a back face of the antenna element.

Figure 8:
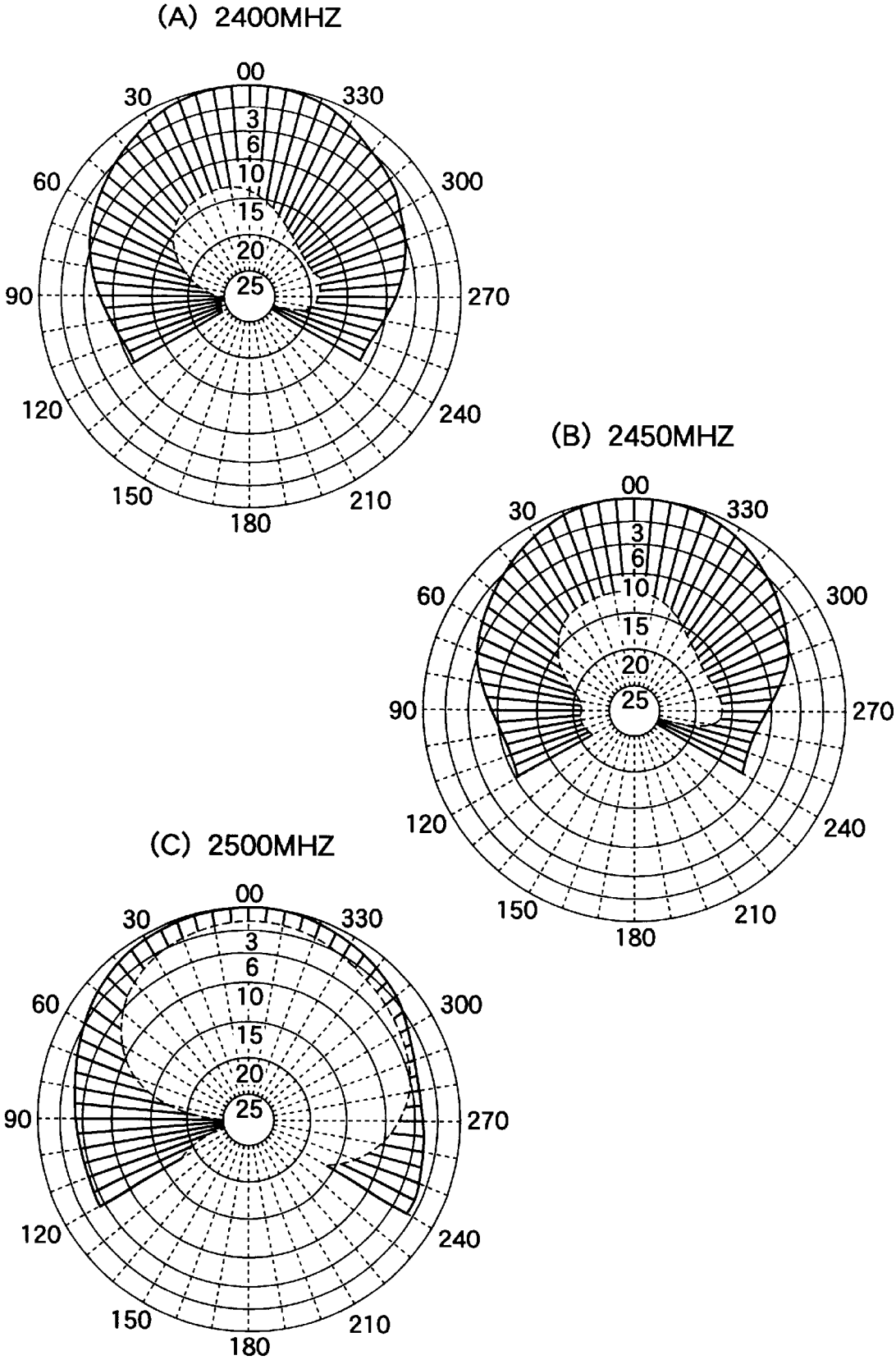
FIG. 8 is also a plurality of diagrams for explaining characteristics of a plane antenna according to the present invention.
Figure 9:
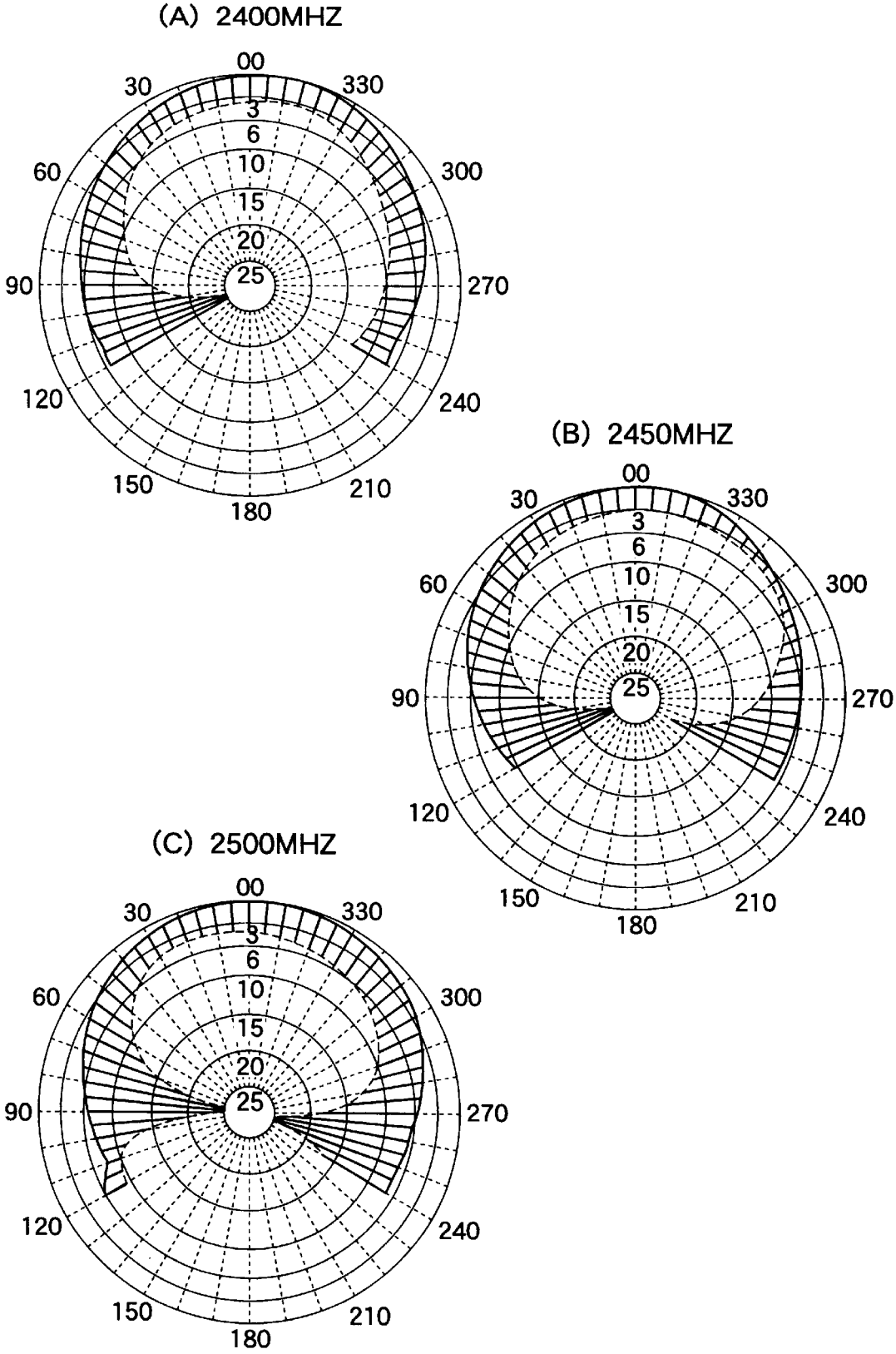
FIG. 9 is also a plurality of diagrams for explaining characteristics of a plane antenna according to the present invention.

Although input ports of the 90° hybrid are connected to the feeding points of the antennas intersecting orthogonally with each other, only one of a pair of ports is used to be connected to a receiving or a transmitting circuit. If the unused port is left open, the better axial ratio may be obtained in the higher frequency side, but in the lower frequency side, the matching may be seriously disturbed, resulting in a poor characteristic, as shown in FIG. 8. This may be solved by matching with a 50Ω resistor, and thereby the axial ratio may be improved for a broad band range, as shown in FIG. 9.

If a resistor is coupled thereto in order to accomplish the matching, a mounting process would be required, and consequently a printing-mounting-reflowing process should be added. If this could be replaced with a conductor pattern having a 50Ω impedance at a used frequency, a manpower for the manufacturing processes may be saved.

Figure 10:
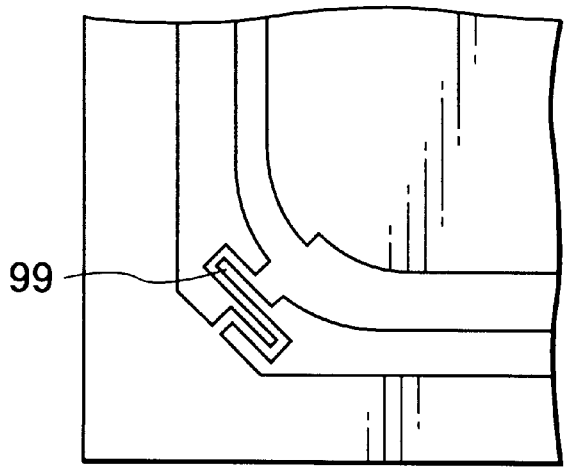
FIG. 10 is a partial plan view, illustrating an embodiment of the present invention.

In this viewpoint, it is considered that a meandering conductor pattern is formed up upon fabricating a 90° hybrid. For example, in order to obtain 50Ω at 2.45 GHz, an inductance of 3.3 nH may be formed, as determined from the relationship of $L=Z/(2\pi f)$. FIG. 10 shows an example of a meandering conductor pattern 99 formed between a connecting point of a 90° hybrid and an earth pattern.

In this case, the impedance for a matching can be formed as one body and at the same time with the 90° hybrid, and thereby the manpower of manufacturing processes may be saved and a reliable plane antenna may be obtained, as well.

Figure 11:
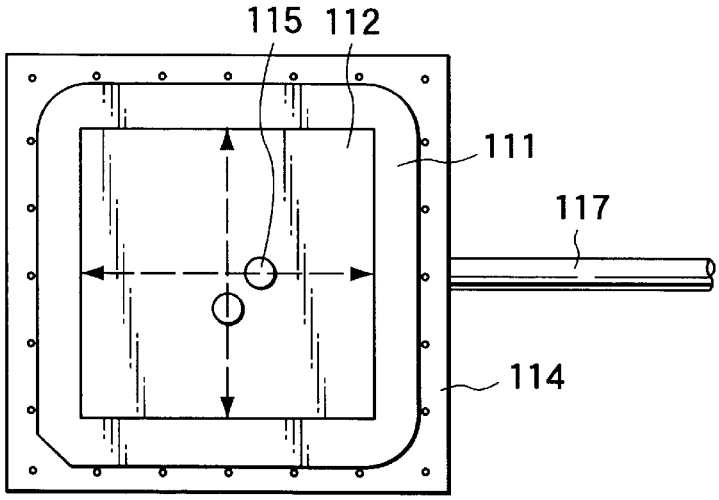
FIG. 11 illustrates an embodiment of the present invention, wherein (A) is a plan view, (B) is a front elevational view, and (C) is a rear plane view respectively.
Figure 11:
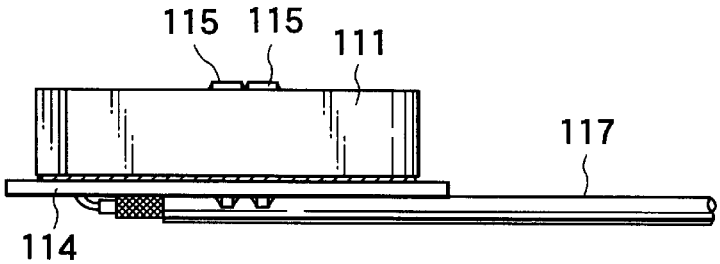
Figure 11:
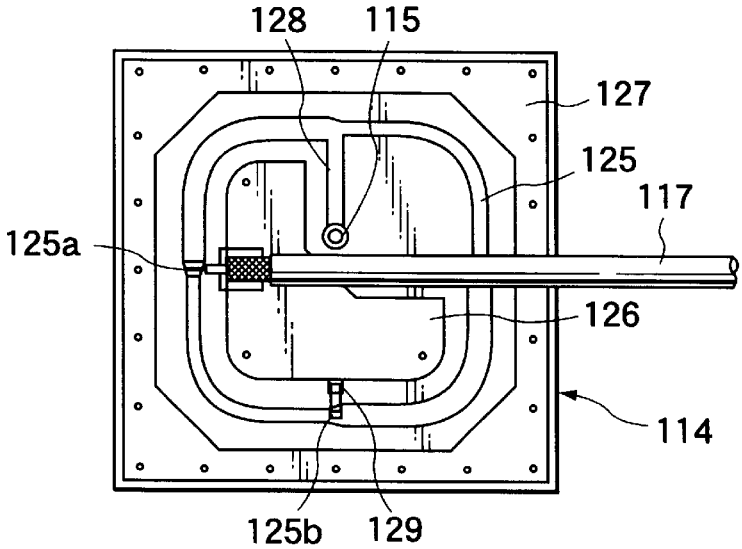

FIG. 11 shows another embodiment of the present invention, wherein (A) is a plan view, (B) is a front elevational view and (C) is a rear plane view, respectively.

An antenna element 111, for a center frequency of 2450 MHz and a band width of 100 MHz, comprises a square patch electrode 112 of 20 mm×20 mm formed on the surface of a square dielectric substrate of 26 mm×26 mm having a thickness of 6 mm and a dielectric constant of 8. The antenna element 111 is composed of two independent micro strip antennas in which an X-directional and a Y-directional polarization axes intersect with each other orthogonally and each of feeding pins 115 is penetrated though each of two 50Ω points disposed on the orthogonal lines connecting center points on respective two opposite sides of the patch.

A wiring board 114 is made to have a grounding pattern covering its one full surface except for a clearance at the locations of the feeding pins 115 of the antenna element, thus to be formed into a grounding conductor. The feeding is made via a 90° hybrid, and a connection to an external circuit is established via a coaxial line 117.

Figure 12:
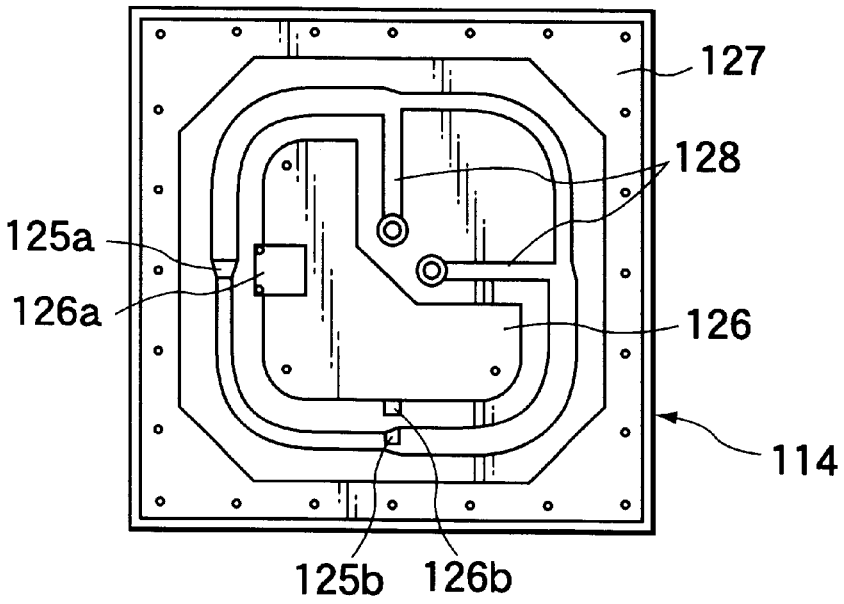
FIG. 12 is a rear plane view of an exemplary wiring board to be used in the present invention.

FIG. 12 is a plan view of the wiring board according to the above embodiment. It shows an example of a conductor pattern to be formed on one face of a two-layer wiring board 114. A formed conductor pattern 125 of a 90° hybrid has one wave length in one circle of 70.4 mm (a diameter of about 22.4 mm), having different characteristic impedance portions of 35.4Ω and 50Ω placed alternately by every 90° along the circle, with the corner portions thereof being round and the portions between respective corner portions being straight lines. An earth pattern 126 is formed inside the closed conductor pattern 125. It is to be noted that the periphery of the closed conductor pattern may be surrounded by an earth pattern 127 for the purpose of anti-warping and reinforcement of the wiring board.

A pair of ports 128 composed of two conductor patterns of the same length having the characteristic impedance of 50Ω is drawn out from the opposite ends of one of the 50Ω arms respectively toward the inside of the closed conductor pattern 125. Said ports 128 are extended to the locations corresponding to those feeding points of the antenna element and are connected via the feeding pins 115 to a radiation electrode.

One of the ends of the other 50Ω arm is coupled with the coaxial line at the characteristic impedance of 50 ohms. That is, one end 125*a* of the 50Ω arm is coupled with the core line of the coaxial line and the earth pattern in its adjacent portion 126*a* is connected with the sheath line of the coaxial line. The other end portion 125*b* of the 50Ω arm is connected to an adjacent portion 126*b* of the earth pattern, also at a matched impedance of 50Ω. Typically, a chip resistor is soldered thereto to have the impedance matched to a specified level. The earth pattern has been coupled to the full face grounding conductor (not shown) on the opposite surface by through holes or the like.

Figure 13:
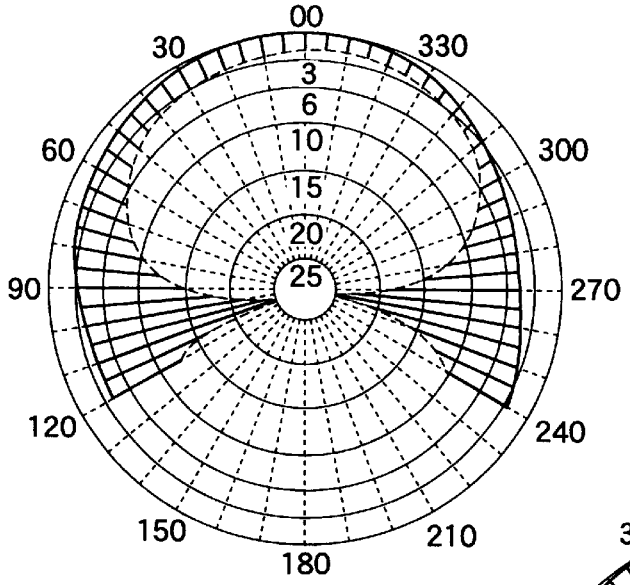
FIG. 13 is a plurality of diagrams for explaining axial ratio-elevation angle characteristics.
Figure 13:
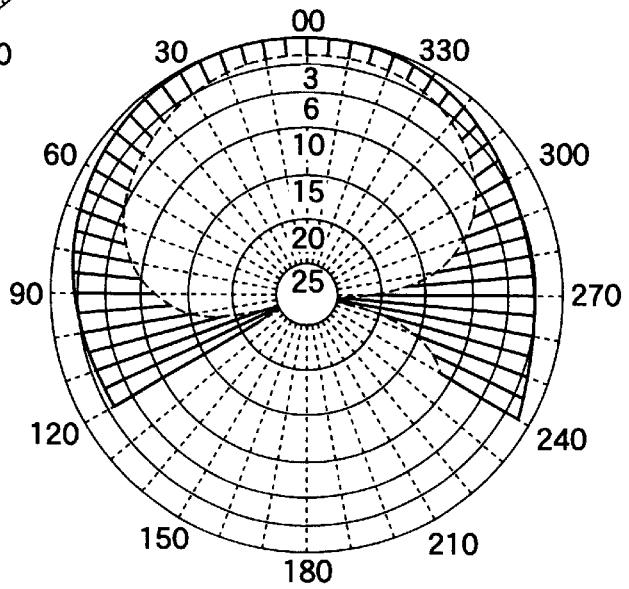
Figure 13:
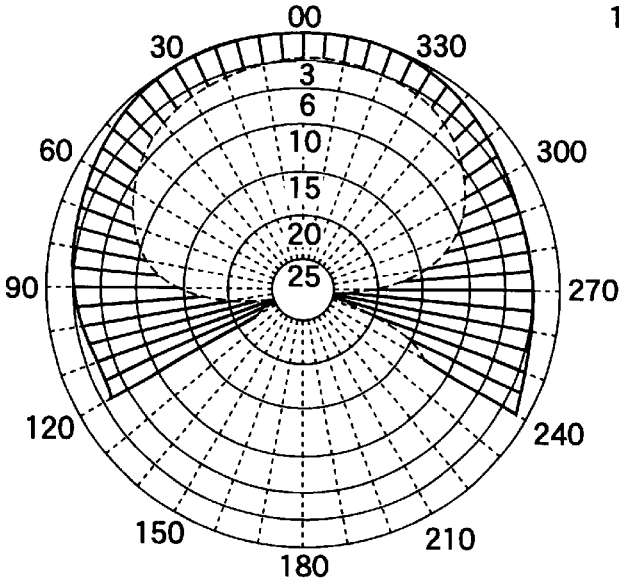
Figure 14:
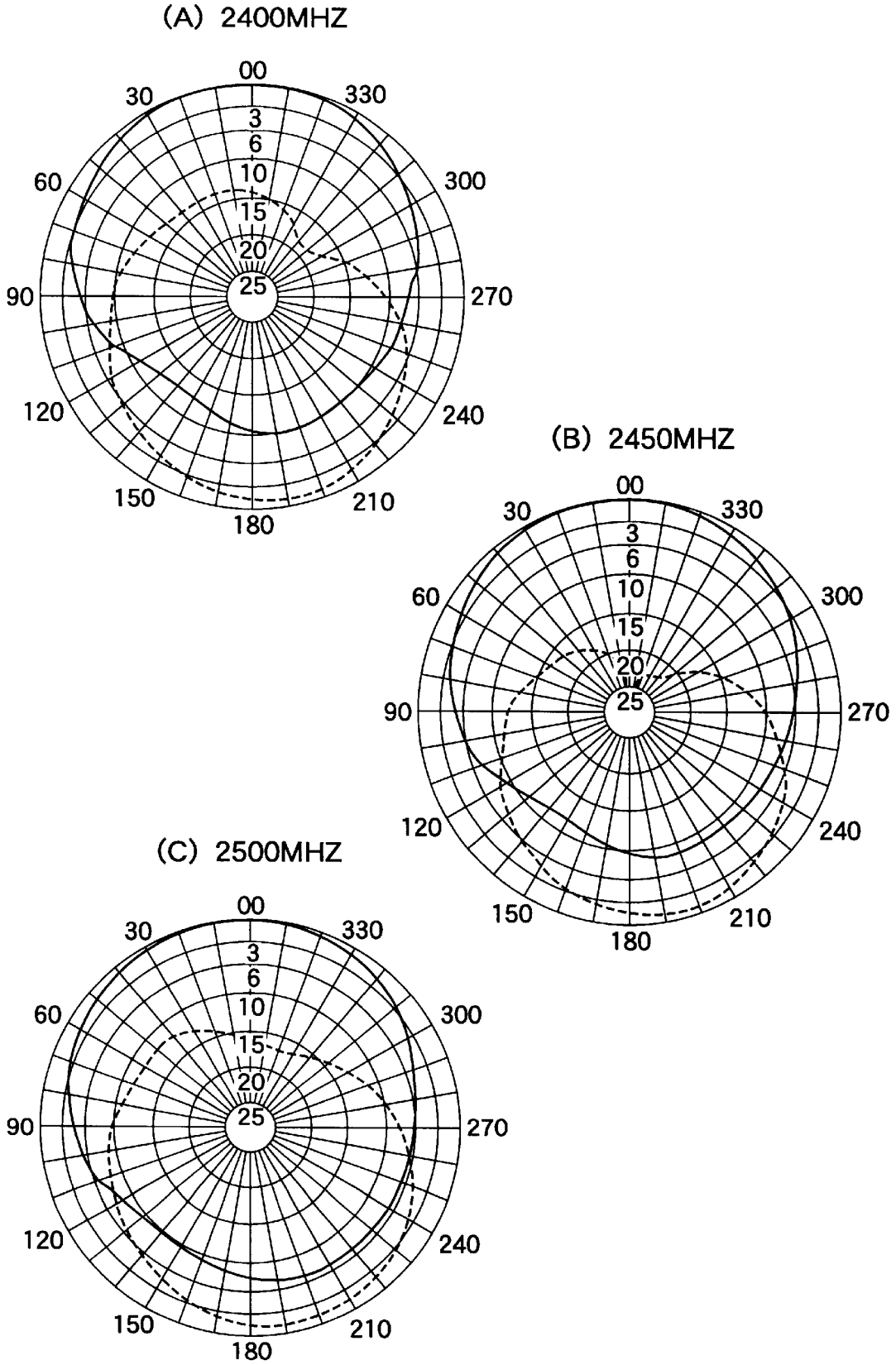
FIG. 14 is a plurality of diagrams for explaining cross polarization directivity characteristics.

FIGS. 13 and 14 show axial ratio-elevation angle characteristics and cross polarization directivity characteristics, respectively. A two-point feeding circularly polarized wave antenna according to the present invention exhibits good axial ratio-frequency characteristic.

FIG. 13 shows the axial ratio characteristic for each of the different radiation angles at the edge frequency in the frequency band width and the axial ratio characteristic for each of the different radiation angles at the center frequency in the frequency band width, in the case where the 90° hybrid wiring board comprises the conductor pattern having one wave length in one circle and the earth pattern arranged inside thereof, and the conductor pattern 125 and the earth pattern 126 in the center portions of the left side of the board 114 are coupled with the coaxial line, which extends across the closed conductor pattern 125 to the opposite side to be drawn to the outside. That is the case where the core line of the coaxial line is drawn out at a location of centerline of the side in the direction normal to the side. In each of the graphs, longer bar length indicates poorer axial ratio. Those have been measured for a range of the central axis ±120° at three different frequencies, and because a circle may be seen as a straight line as viewed from the horizontal direction, the axial ratio is shown to have been deteriorated more along the direction inclined from the front axis but has achieved not greater than 6 dB for a range defined along the direction of the central axis ±60° at the frequency band width of 2400 to 2500 MHz.

On the other hand, FIG. 14 shows the directivity characteristics for a circularly polarized wave in a desired turning direction together with the directivity characteristics for a cross polarized wave, where the term, a cross polarized wave, means a circularly polarized wave in the turning direction opposite (a left-handed circularly polarized wave "LHCP" in this embodiment) relative to a circularly polarized wave in the desired turning direction (a right-handed circularly polarized wave "RHCP" in this embodiment). The directivity for the circularly polarized wave in the desired turning direction is shown to have achieved an attenuation to a level of about 10 db or smaller along the direction normal to the axial direction and the approximately half-spherical directivity has been obtained. The attenuation along the direction defined by the central axis ±30° to the cross polarized wave is shown to have good characteristics of 10 db or higher.

Each of the resonant frequencies in the X- and Y-directions of the antenna may be determined depending on the equivalent sizes in the X- and Y-directions of the antenna element and the grounding face on the back surface. The sheath line of the coaxial line is coupled with the ground, while the core line of the coaxial line is coupled with the port of the closed conductor pattern. In the above embodiment, since the coaxial line is guided from a corner of the closed conductor pattern across the pattern to the opposite side to be drawn out, a substantial variation in the size of the grounding face affecting the resonant frequencies can be made smaller, which results in a smaller variation in each of the resonant frequencies in the X- and Y-directions possibly caused by the layout of the coaxial line to be drawn out, and thus the axial ratio characteristic of the circularly polarized wave property may be remain unaffected.

Figure 15:
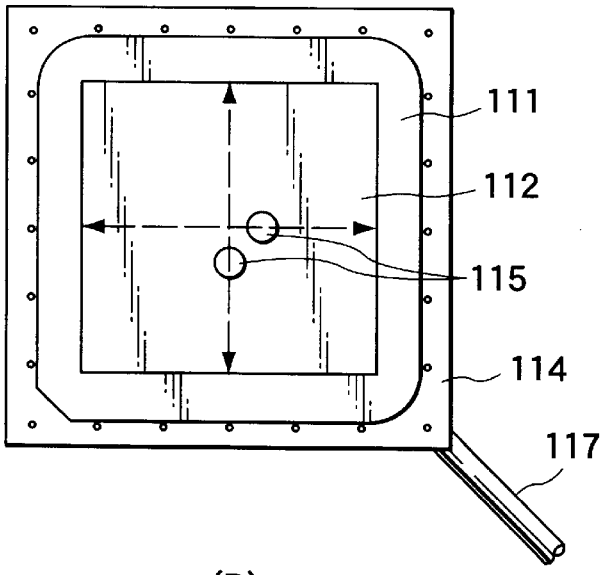
FIG. 15 illustrates alternative embodiment of the present invention, wherein (A) is a plan view, (B) is a front elevational view, and (C) is a rear plane view respectively.
Figure 15:
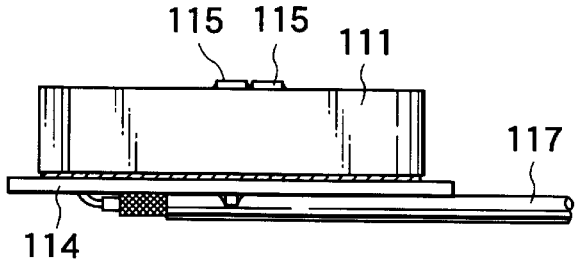
Figure 15:
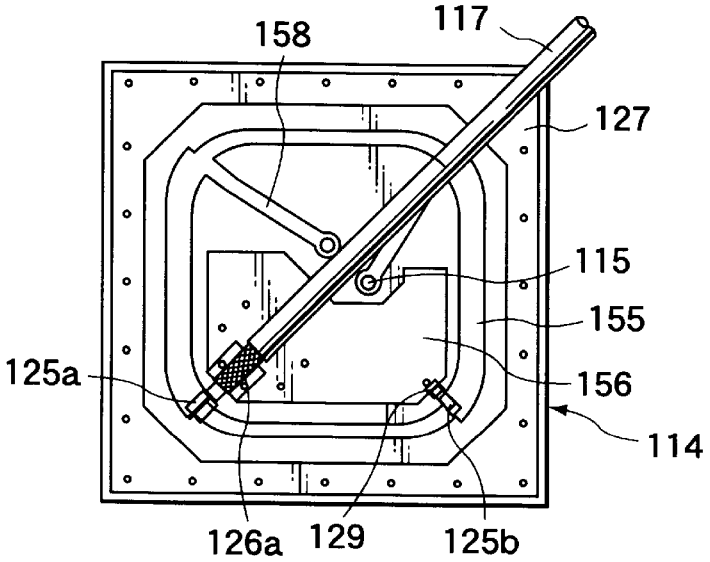

FIG. 15 shows another embodiment of the present invention, where a 90° hybrid is formed differently. In this embodiment, a closed conductor pattern 155 of the 90° hybrid is arranged such that connecting points of arms are positioned on the diagonal lines of a square wiring board, and conductor patterns 158 of 50Ω having the same length are extended inwardly from respective ends of a 50Ω arm to locations corresponding to feeding points of an antenna element.

To explain about the connection structure between the 90° hybrid and a coaxial line shown in FIG. 15, a pattern drawn out inwardly from the contact point of the 90° hybrid conductor pattern 155 is coupled with the core line of a coaxial line 117, while an earth pattern 156 arranged inside the closed conductor pattern is coupled with the sheath line of the coaxial line 117. The other reference numerals used in FIG. 15 are designated similarly to those used in the embodiment shown in FIG. 11.

FIG. 15 shows the example, in which the connecting point of the coaxial line to the arm is located at both ends of a 50Ω arm disposed in the bottom side of the wiring board and the drawing-out direction of the coaxial line to the outside is matched to the diagonal line of the wiring board, and such layout as drawing out at the corner portion to traverse the pattern in the diagonal direction allows the grounding board to be sized equivalently in the X- and Y-directions, the substantial size variation of the grounding face to be reduced, and the affection in each of the resonant frequencies in the X- and Y-directions possibly caused by the layout of the coaxial line to be reduced, so that the axial ratio-frequency range can be expanded to provide good axial ratio characteristics.

The size of the antenna element is determined based on the dielectric constant of the dielectric antenna element, while the dielectric constant of the wiring board is selected to be effectively within a range of 40% to 130% of the dielectric constant of the antenna element, and the 90° hybrid pattern should be accommodated in the back surface of the antenna element.

Input ports of the 90° hybrid are connected to the feeding points of the antenna. In another pair of ports, typically only one port is used for a connection to a receiving or transmitting circuit. The unused port is matched by the 50Ω to improve the axial ratio in the broad band.

Although the example of a square antenna element has been used to explain the above embodiments, the antenna element may be circular. Further, a wiring board constructing a 90° hybrid may be three or more-layer type to have a tri-plate configuration. Alternatively, a coaxial line may be replaced with a micro strip line on the face opposite to a partial grounding conductor in which the micro strip line is connected to a port of the hybrid.

EFFECT OF THE INVENTION

According to the present invention, since the 90° hybrid is allowed to be accommodated on the back face of the antenna element, an extremely small plane antenna may be obtained.

In the 90° hybrid of the present invention, the grounding face of the plane antenna element is arranged on the top surface of a printed board, while the conductor pattern having one wave length in one circle is arranged on the back surface thereof together with the earth pattern formed outside or inside the conductor pattern, and the elements are placed over the grounding face. Drawing-out direction of the coaxial line to be connected with the conductor pattern and the earth pattern across the wiring board or along the diagonal line of the wiring board allows to keep a balance between the X-directional and Y-directional resonant frequencies, and thereby such a circularly polarized wave plane antenna which has good and stable axial ratio characteristics in the circular polarization property may be obtained. Since such plane antenna provides the good axial ratio characteristics over the broad frequency band, it is considered to be suitable for communication requiring improved axial ratio characteristics in a broad range.

Further, since an impedance for obtaining a matching may be formed as one body and at the same time with the 90° hybrid, the manpower for manufacturing would be saved and a highly reliable plane antenna may be obtained as well.

What is claimed:

1. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports to connect said conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out toward an inside of said closed conductor pattern, and an earth pattern is formed on the same surface as of said closed conductor pattern; wherein said inwardly drawn out ports are connected with said feeding points, one of said ports of said closed conductor pattern and said earth pattern are connected with a core line and a sheath line of a coaxial line respectively; and said 90° hybrid is disposed in a back face of said dielectric plane antenna element.

2. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports to connect said closed conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out toward an inside of said closed conductor pattern, and an earth pattern is formed surrounding said closed conductor pattern; wherein said inwardly drawn out ports are connected with said feeding points, one of said ports of said closed conductor pattern and said earth pattern are connected with a core line and a sheath line of a coaxial line respectively; and said 90° hybrid is disposed in a back face of said dielectric plane antenna element.

3. A plane antenna in accordance with claim 2, in which said wiring board is a two-layer wiring board, and a back face of the face having a 90° hybrid formed thereon is made to be a grounding conductor of a dielectric plane antenna element.

4. A plane antenna in accordance with claim 2, in which a dielectric constant of said wiring board is within a range of 40% to 130% of the dielectric constant of said dielectric plane antenna element.

5. A plane antenna in accordance with claim 2, in which the other port not to be connected to the feeding points nor the coaxial line is connected with the earth pattern via an impedance element.

6. A plane antenna in accordance with claim 5, in which said impedance element is an inductance element by means of conductor pattern formed on the wiring board.

7. A plane antenna in accordance with claim 5, in which said wiring board is a two-layer wiring board having a size approximately corresponding to a size of the dielectric plane antenna element, and a back face of the face having the 90° hybrid formed thereon is made to be a grounding conductor of the dielectric plane antenna element.

8. A plane antenna in accordance with claim 5, in which a dielectric constant of said wiring board is within a range of 40% to 130% of the dielectric constant of said dielectric plane antenna element.

9. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports to connect said closed conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out toward an inside of said closed conductor pattern, and an earth pattern is formed surrounding said closed conductor pattern; wherein said inwardly drawn out ports are connected with said feeding points, one of said ports of said closed conductor pattern and said earth pattern are connected with a coaxial line respectively at central locations on a side of said closed conductor pattern; and said 90° hybrid is disposed in a back face of said dielectric plane antenna element.

10. A plane antenna in accordance with claim 9, in which said wiring board is a two-layer wiring board having a size approximately corresponding to a size of a dielectric plane antenna element, and a back face of the face having a 90° hybrid formed thereon is made to be a grounding conductor of the dielectric plane antenna element.

11. A plane antenna in accordance with claim 9, in which a dielectric constant of said wiring board is with a range of 40% to 130% of the dielectric constant of said dielectric plane antenna element.

12. A plane antenna in accordance with claim 9, in which the other port not to be connected to the feeding points nor the coaxial line is connected with the earth pattern via an impedance element.

13. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports to connect said closed conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out from corner locations of pattern, and an earth pattern is formed surrounding said closed conductor pattern; wherein said inwardly drawn out ports are connected with said feeding points, one of said ports of said closed conductor pattern and said earth pattern are connected with a core line and a sheath line of a coaxial line respectively at locations approximately on a diagonal line of said wiring board; and said 90° hybrid is disposed in a back face of said dielectric plane antenna element.

14. A plane antenna in accordance with claim 13, in which said wiring board is a two-layer wiring board having a size approximately corresponding to a size of a dielectric plane antenna element, and a back face of the face having a 90° hybrid formed thereon is made to be a grounding conductor of the dielectric plane antenna element.

15. A plane antenna in accordance with claim 13, in which a dielectric constant of said wiring board is within a range of 40% to 130% of the dielectric constant of said dielectric plane antenna element.

16. A plane antenna in accordance with claim 13, in which the other port not to be connected to the feeding points nor the coaxial line is connected with the earth pattern via an impedance element.

17. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports to connect said closed conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out toward an inside of said closed conductor pattern, and an earth pattern is formed inside said closed conductor pattern; wherein said inwardly drawn out ports are connected with said feeding points, one of said ports of said closed conductor pattern and said earth pattern are connected with a core line and a sheath line of a coaxial line respectively; and said 90° hybrid is disposed in a back face of said dielectric plane antenna element.

18. A plane antenna in accordance with claim 17 in which said wiring board is a two-layer wiring board, and a back face of the face having a 90° hybrid formed thereon is made to be a grounding conductor of the dielectric plane antenna element.

19. A plane antenna in accordance with claim 17, in which a dielectric constant of said wiring board is within a range of 40% to 130% of the dielectric constant of said dielectric plane antenna element.

20. A plane antenna in accordance with claim 17, in which the other port not to be connected to the feeding point or the coaxial line is connected with the earth pattern via an impedance element.

21. A plane antenna in accordance with claim 20, in which said wiring board is a two-layer wiring board having a size approximately corresponding to a size of a dielectric plane antenna element, and a back face of the face having a 90° hybrid formed thereon is made to be a grounding conductor of the dielectric plane antenna element.

22. A plane antenna in accordance with claim 20, in which a dielectric constant of said wiring board is within a range of 40% to 130% of the dielectric constant of said dielectric plane antenna element.

23. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, which includes two ports to connect said closed conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out toward an inside of said closed conductor pattern, and an earth pattern is formed in an island-like shape inside said closed conductor pattern; wherein said inwardly drawn out ports are connected with said feeding points, one of said ports of said closed conductor pattern and said earth pattern are connected with a core line and a sheath line of a coaxial line respectively at central locations on a side of said closed conductor pattern; and said 90° hybrid is disposed in a back face of said dielectric plane antenna element.

24. A plane antenna in accordance with claim 23, in which said wiring board is a two-layer wiring board having a size approximately corresponding to a size of the dielectric plane antenna element, and a back face of the face having a 90° hybrid formed thereon is made to be a grounding conductor of the dielectric plane antenna element.

25. A plane antenna in accordance with claim 23, in which a dielectric constant of said wiring board is within a range of 40% to 130% of the dielectric constant of said dielectric plane antenna element.

26. A plane antenna in accordance with claim 23, in which the other port not to be connected to the feeding point or the coaxial line is connected with the earth pattern via an impedance element.

27. A plane antenna comprising:

a dielectric plane antenna element using a resonance mode of two axial directions orthogonally passing through a center point of a conductor pattern arranged on a dielectric substrate and having a feeding point at a 50Ω matching point on each of the axial lines; and a 90° hybrid comprising a closed conductor pattern having one wave length in one circle, with includes two port to connected said closed conductor pattern with each of said feeding points and two coaxial line connecting ports, at least one of which is connected to a transmitting or receiving circuit, said plane antenna characterized in that:

said 90° hybrid is formed into a wiring board having not less than two layers, said two ports to be connected to said feeding points are drawn out from locations on the diagonal lines of said closed conductor pattern toward an inside thereof, and an earth pattern is formed in an island-like shape inside said closed conductor pattern; wherein said inwardly drawn out ports are connected with said feeding points, one of said ports of said closed conductor pattern and said earth pattern are connected with a core line and a sheath line of a coaxial line respectively at the locations approximately on the diagonal line of the wiring board; and said 90° hybrid is disposed in a back face of said dielectric plane antenna element.

28. A plane antenna in accordance with claim 27, in which said wiring board is a two-layer wiring hoard having a size approximately corresponding to a size of the dielectric plane antenna element, and a back face of the face having a 90° hybrid formed thereon is made to be a grounding conductor of the dielectric plane antenna element.

29. A plane antenna in accordance with claim 27, in which a dielectric constant of said wiring board is within a range of 40% to 130% of the dielectric constant of said dielectric plane antenna element.

30. A plane antenna in accordance with claim 27, in which the other port not to be connected to the feeding point or the coaxial line is connected with the earth pattern via an impedance element.

* * * * *